US008576264B2

(12) United States Patent
Lyga et al.

(10) Patent No.: US 8,576,264 B2
(45) Date of Patent: Nov. 5, 2013

(54) REGISTRATION DEVICE FOR MAIL PROCESSING SYSTEM HAVING WIDE PRINT NOZZLE ARRAYS

(75) Inventors: Thomas M Lyga, Southbury, CT (US); John R. Masotta, Newtown, CT (US); John W. Sussmeier, Cold Spring, NY (US); John F. Pezzuti, Naugatuck, CT (US)

(73) Assignees: Pitney Bowes Inc., Stamford, CT (US); Hewlett-Packard Company, San Diego, CA (US)

( * ) Notice: Subject to any disclaimer, the term of this patent is extended or adjusted under 35 U.S.C. 154(b) by 176 days.

(21) Appl. No.: 13/300,791

(22) Filed: Nov. 21, 2011

(65) Prior Publication Data

US 2013/0127968 A1 May 23, 2013

(51) Int. Cl.
*B41J 2/00* (2006.01)
*B41J 25/308* (2006.01)
*B41J 2/39* (2006.01)

(52) U.S. Cl.
USPC ..... 347/110; 347/8; 347/141

(58) Field of Classification Search
None
See application file for complete search history.

(56) References Cited

U.S. PATENT DOCUMENTS 5,923,343 A 7/1999 Brosseau et al.

*Primary Examiner* — Stephen Meier
*Assistant Examiner* — Alexander C Witkowski
(74) *Attorney, Agent, or Firm* — Brian A. Lemm; Charles R. Malandra, Jr.; Steven J. Shapiro

(57) ABSTRACT

A registration device for a mail processing system having wide print nozzle arrays that reduces problems associated with printing on variable thickness media. A thin wire, held by guides, is strung across the print nozzle openings in the registration plate to support and guide the top (print) surface of a mail piece and to prevent the mail piece from protruding into the openings. The guides are positioned such that the wire passes between zones where there are no print nozzles located. A tensioning device is provided to adjust the tension of the wire to ensure the wire maintains its position within the openings. The wire acts as a guide to maintain the optimal gap between the mail piece top surface and the print nozzles.

12 Claims, 4 Drawing Sheets

REGISTRATION DEVICE FOR MAIL PROCESSING SYSTEM HAVING WIDE PRINT NOZZLE ARRAYS

FIELD OF THE INVENTION

The invention disclosed herein relates generally to mail processing systems, and more particularly to a registration device for mail processing systems that utilize wide print nozzle arrays.

BACKGROUND OF THE INVENTION

Mail processing systems, such as, for example, a mailing machine, inserter, and the like, often include different modules that automate the processes of producing mail pieces. A typical mail processing system includes a variety of different modules or sub-systems each of which performs a different task on the mail piece. The mail piece is conveyed downstream utilizing a transport mechanism, such as rollers or a belt, to each of the modules. In a mailing machine, such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering/printing module, i.e., applying evidence of postage to the mail piece. In an inserter, such modules could include one or more feeders and collators, an envelope stuffing module, a moistening/sealing module, i.e., wetting and closing the glued flap of an envelope, a weighing module, and a metering/printing module, i.e., applying evidence of postage to the mail piece. The exact configuration of the mail processing system is, of course, particular to the needs of the user.

Modern mail processing systems utilize digital printing techniques for producing images on a mail piece. Conventional digital printing techniques include bubble jet and ink jet, each of which produces an image in a dot matrix pattern. With digital printing, individual print head elements (such as resistors or piezoelectric elements) are selectively electronically stimulated to expel drops of ink from a reservoir onto a substrate, e.g., a mail piece. In either case, by controlling the timing of energizing of the individual print head elements in conjunction with the relative movement between the print head and the mail piece, a dot matrix pattern is produced in the visual form of the desired image. In the case of mail processing systems, the image may be, for example, an indicium that evidences payment of postage or advertisements printed on the outside of a mail piece.

Digital printing technology has significant advantages when used in a mail handling apparatus as compared to older technology that utilized either a flat platen or a rotary drum to imprint information, such as, for example, address information or an indicium, on mail pieces. For example, if some variable image data needs to be changed, it can easily be done through the installation of new or upgraded software versus having to replace the entire printing module, since the flat platen and drum are typically not separately removable. Moreover, greater printing speeds can be obtained as compared to conventional mechanical printing systems. However, the use of a digital print head in a mailing system presents other issues that must be taken into consideration. For example, for the ink jet nozzles of an ink jet printer to properly deposit ink on the surface of the receiving medium, it is critical that a small predetermined gap be maintained between the exit plane of the nozzles and the surface of the receiving medium, typically in the order of 0.02 to 0.08 inches (0.5 to 2.0 mm). This gap is necessary to achieve acceptable image quality, since too small a gap causes scuffing of the print head and to large a gap results in inaccurate dot placement, with either situation resulting in a deteriorated print image. Thus, in the mail handling environment, it becomes necessary to maintain this critical gap between the exit plane of the ink jet nozzles and the upper surface of the mail pieces being conveyed through the mailing machine.

To accomplish this, the mail pieces, such as, for example, envelopes, postcards, flats, and the like, must be conveyed with the front panels on which the information is printed lying in a fixed registration plane, which is disposed beneath the exit plane of the nozzles a distance equal to the aforementioned gap. This arrangement is referred to hereinafter as top registration. To accomplish this top registration, a biasing force is applied to the back panel of the mail piece such that the front panel maintains light contact with a registration plate. This contact slightly compresses and flattens out the mail piece, thereby establishing its surface at the ideal gap distance from the print head nozzles. An opening is provided in the registration plate, above which the print head is located such that the print head can print on the mail piece as it passes the opening in the registration plate.

There are problems, however, with the conventional top registration transports in mail processing systems. Conventional registration plates maintain the desired gap when printing on thin or constant thickness media in which the print surface is flat. When printing on variable thickness media, however, such as mail pieces that are filled with different amount of inserts that tend to make the mail pieces "puffy" or have distorted top surfaces, it is difficult for conventional registration plates to maintain the desired gap due to the variations in the surface profile of the mail piece. This problem is exacerbated when the printing zones are wide, which requires the use of wide print nozzle arrays to perform the printing, as the openings in the registration plate must also be larger to accommodate the print nozzle arrays. These larger openings do not provide support for the mail pieces, resulting in large variations in the surface profile of many mail pieces as they pass under the print nozzles. This results in variations in the spacing between the print nozzles and the surface of the mail piece, which in turn causes poor print quality. In addition, the variations in the surface profile can result in a portion of the mail piece surface protruding into the opening and contacting the print nozzles as it is transported past the print head, which can cause smearing of the ink and potentially damage the print nozzles. Additionally, if there is a jam of the mail pieces being transported in the printing area, there is a much greater chance that a mail piece will be forced into the opening, because of the larger openings, and contact the print nozzles.

Thus, there exists a need for a top registration device for a mail processing system that utilizes wide print nozzle arrays that reduces the problems associated with printing on variable thickness media.

SUMMARY OF THE INVENTION

The present invention alleviates the problems associated with the prior art and provides a registration device for a mail processing system having wide print nozzle arrays that reduces the problems associated with printing on variable thickness media.

In accordance with an embodiment of the present invention, a thin wire, held by guides, is strung across the print nozzle openings in the registration plate to support and guide the top (print) surface of a mail piece and to prevent the mail piece from protruding into the openings. The guides are positioned such that the wire passes between zones where there are no nozzles located, thereby avoiding obstruction of the ink droplets as they are expelled from the nozzles onto a mail piece. A tensioning device is provided to adjust the tension of the wire to ensure the wire maintains its position within the openings. The wire is sufficiently thin such that any ink build up on the wires from the ink jet overspray is minimized, thereby minimizing any subsequent transfer of ink to a mail piece when contact with the wire occurs. The wire acts as a guide to maintain the optimal gap between the mail piece top surface and the print nozzles, thereby providing better print quality, and also to prevent the mail pieces from contacting the print nozzles during normal operation and in the event of a jam condition.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, by way of example serve to explain the invention in more detail. As shown throughout the drawings, like reference numerals designate like or corresponding parts.

DETAILED DESCRIPTION OF THE PRESENT INVENTION

Figure 1:
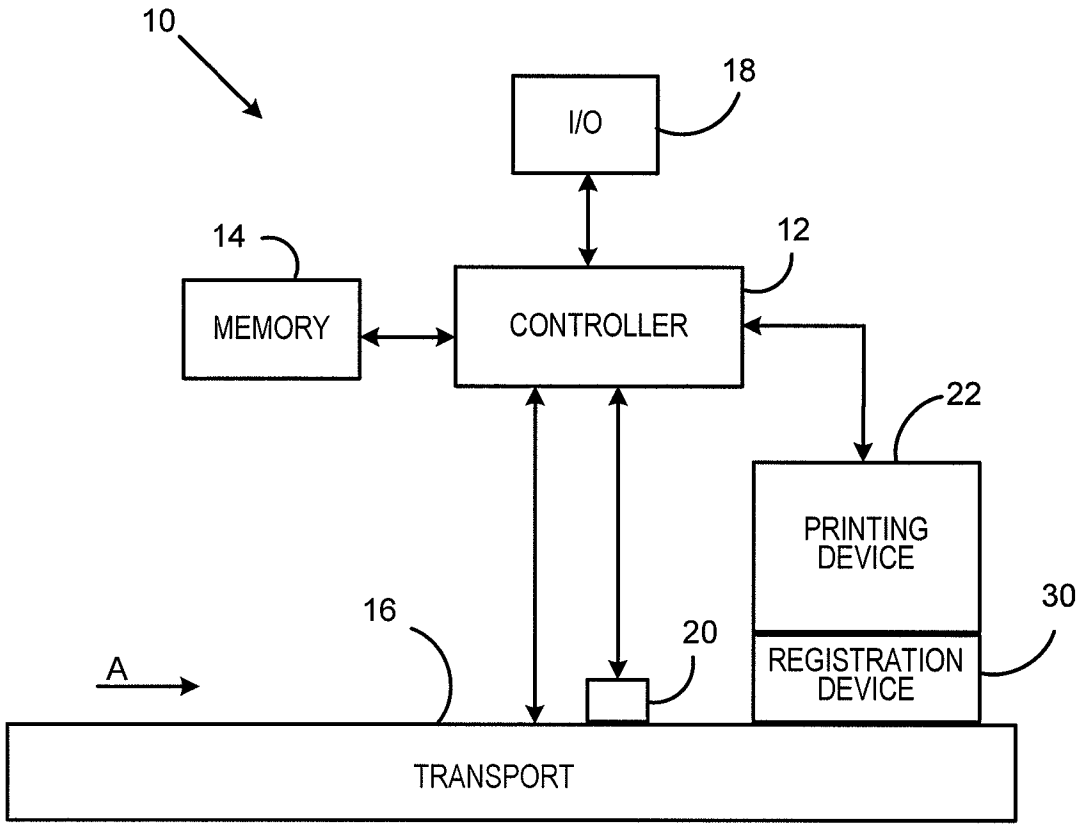
FIG. 1 illustrates in block diagram form portions of a mail processing system in which the present invention can be implemented.

In describing the present invention, reference is made to the drawings, wherein there is seen in FIG. 1 in block diagram form portions of a mail processing system 10 that includes a registration device according to an embodiment of the invention. Mail processing system 10 includes a main controller 12 that controls one or more operations of the mail processing system 10. Main controller 12 may be implemented as hardware, firmware, as a general or special purpose processor that executes commands in response to software, or any combination thereof. A memory 14 is coupled to the controller 12 for storage of data and executable software programs accessed by the controller 12. Controller 12 is coupled to one or more input/output devices 18, such as, for example, a keyboard and/or display unit for the input and output of various data and information. A transport 16 is utilized to move articles, such as, for example, mail pieces, including envelopes, flats, postcards, and the like, through the mail processing system 10 in the direction indicated by arrow A based on signals provided from the controller 12. Transport 16 can be implemented in any conventional manner, such as, for example, a combination of rollers, belts and vacuums, as is well known. One or more sensors 20 (only one illustrated), located along the transport 16, provide the main controller 12 with status signals as to the location of an article along the transport 16. The transport 16 will transport the mail pieces past a printing device 22 such that printing can occur on each mail piece. Printing device 22 can include one or more print heads, with each print head having one or more print nozzle arrays for printing different colors of ink onto a mail piece being transported through the mail processing system 10. A registration device 30 is provided to top register mail pieces for printing as described below.

Figure 2:
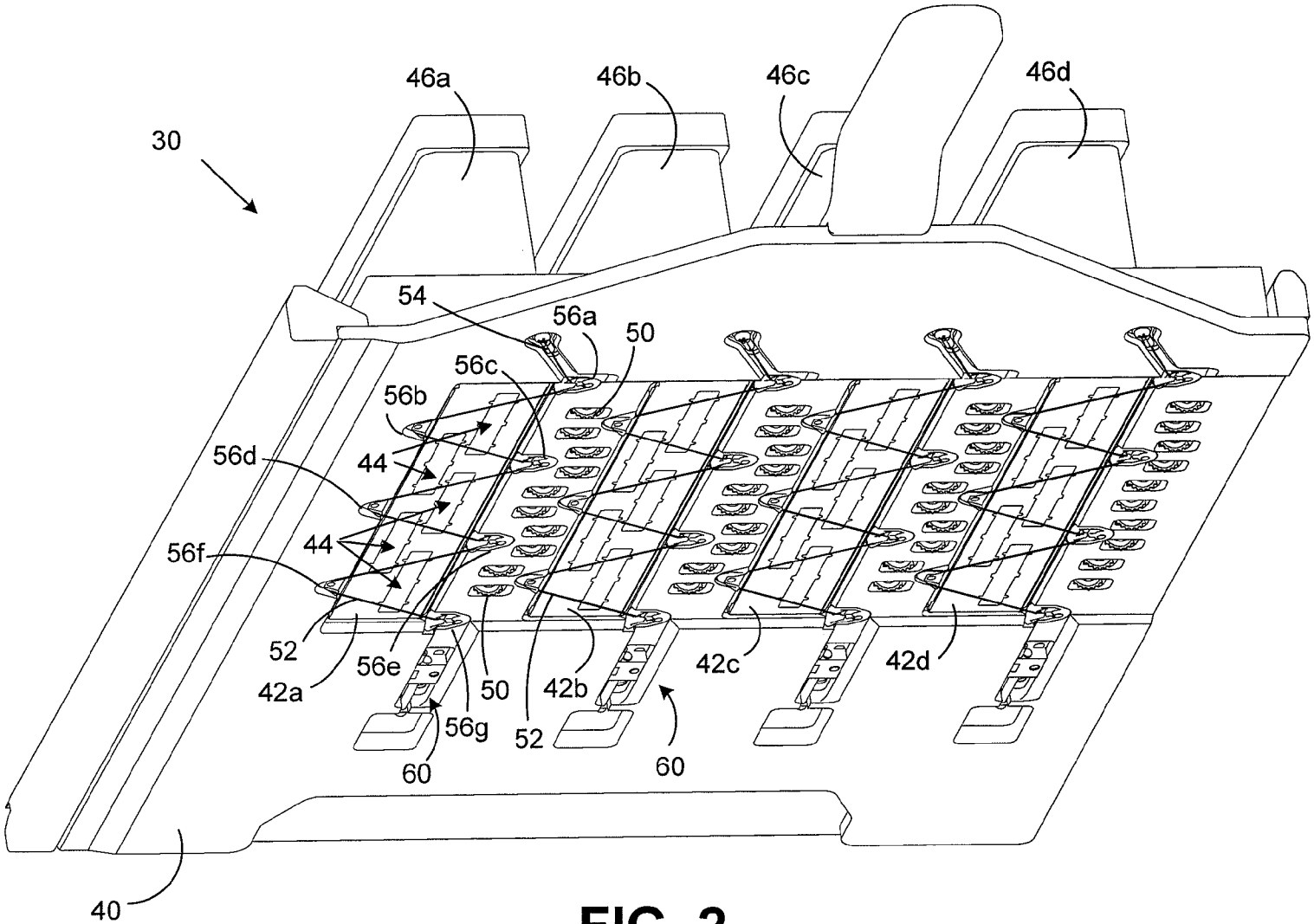
FIG. 2 illustrates a bottom perspective view of a registration device according to an embodiment of the present invention.

FIG. 2 illustrates a bottom perspective view of the registration device 30. A registration plate 40 includes one or more openings 42*a*, 42*b*, 42*c*, 42*d* that allow the print head nozzle arrays 44 of a respective print head 46*a*, 46*b*, 46*c*, 46*d* to be exposed to the surface of a mail piece (not shown) so the nozzles of the respective nozzle arrays 44 drop ink directly onto the surface of the mail piece as it passes by the respective opening 42. It should be understood that while four print heads 46*a*-46*d* (and respective openings 42*a*-42*d*) are illustrated, the number of print heads (and corresponding number of openings) is not so limited and can be any number depending on the application. The registration plate 40 is positioned and set at a pre-determined gap above the path of the mail transport 16, generally in the order of 0.5 to 2.0 mm (0.020 to 0.080 inches). This gap is calculated based on both the nominal free thickness and the compressed thickness of mail pieces that will be passing through the mail processing system. The gap is set such that, for the majority of mail pieces being processed, the mail piece will lightly contact the underside of the registration plate 40 as it is being transported past the print head nozzle arrays 44. This contact will slightly compress and flatten out the mail piece, thereby establishing its surface to be at the preferred spacing from the print head nozzle arrays 44.

To reduce ink smearing, especially on thick mail pieces, it is desirable to prevent the top surface of the mail piece from directly contacting the underside of the registration plate 40 downstream of any print head nozzle arrays 44. To achieve this, those areas of the registration plate 40 are preferably recessed and small idler rollers 50 are mounted on the bottom of the registration plate 40. The idler rollers 50 are mounted such that their outer radius re-establishes the upward planar bound of the mail piece just slightly below the bottom surface of the registration plate 40, thereby preventing the mail piece from contacting the bottom surface of the registration plate 40 in the areas where the idler rollers 50 are located. The idler rollers 50 preferably have small sharp points on their radial perimeter thereby minimizing the point contact with the mail piece, thereby reducing the transfer or smearing of any ink on the mail piece.

Because of the necessary openings 42*a*-42*d* required in the registration plate 40, there is no top support for the mail pieces as they pass under these openings, as the idler rollers 50 cannot be mounted in the openings 42. The size of these openings 42*a*-42*d* is dictated by the size of the print head nozzle arrays 44, and therefore must be wide enough and long enough to accommodate the entire print head nozzle arrays 44. The size of the necessary openings 42*a*-42*d* results in a high probability that very puffy or highly distorted mail pieces, having a free thickness that is greater than the gap established between the registration plate 40 and the transport 16, will protrude up into an opening 42*a*-42*d*. If this protrusion is greater than the nominal print spacing, the mail piece can extend above the plane established by the underside of the registration plate 40 and can contact the print head nozzle arrays 44. Such contact can cause smearing of the ink, or in worst case situations even damage the print head nozzle arrays 44, resulting in poor print quality.

Figure 3:
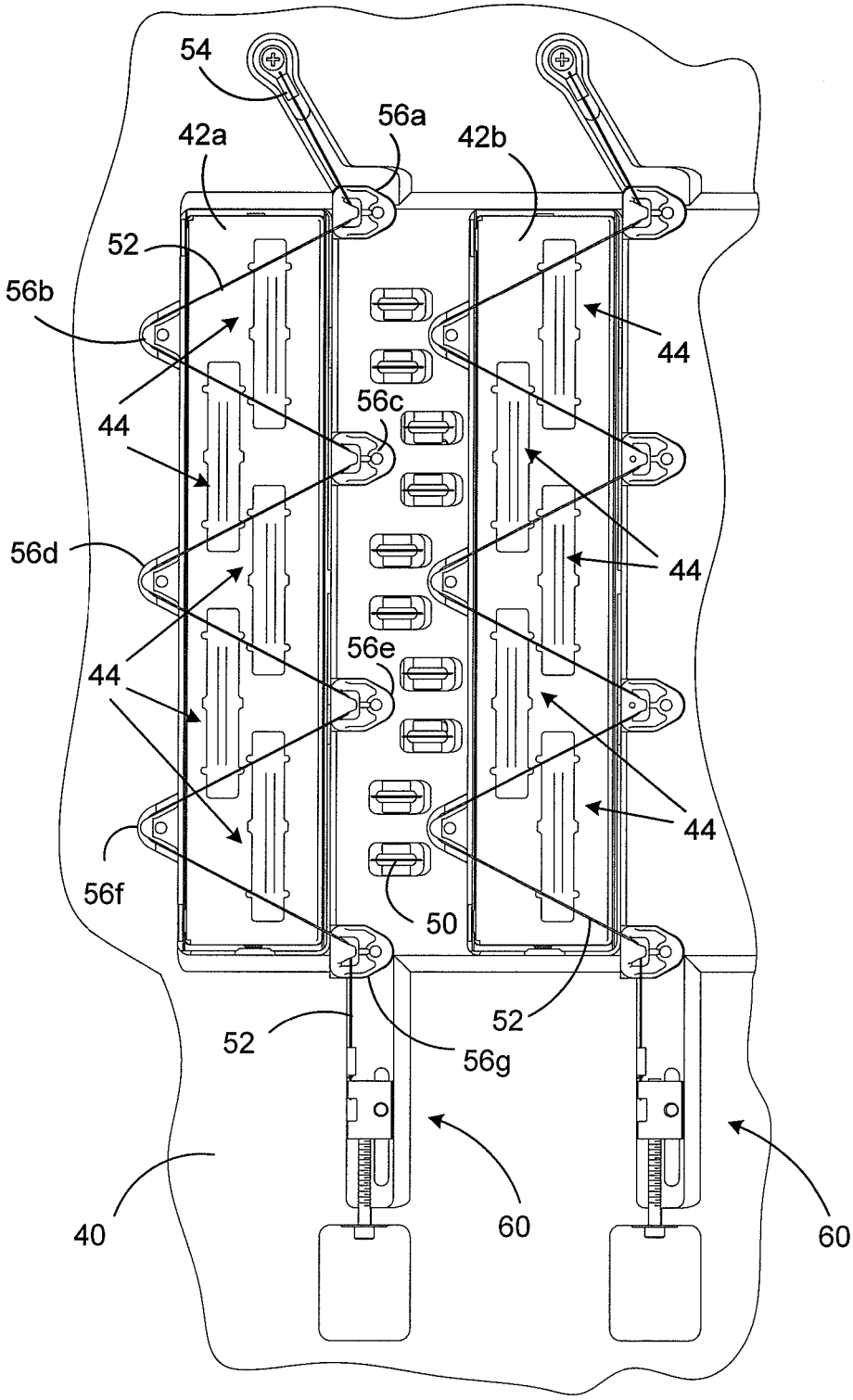
FIG. 3 illustrates a bottom view of a portion of the registration device.

To prevent such contact between the mail piece and print head nozzle arrays 44 from occurring, the openings 42*a*-42*d* in the registration plate 40 are provided with a barrier in the form of a very thin wire 52 that is strung across the openings 42*a*-42*d*. The wire 52 is preferably formed of a material that is resistive to corrosion, such as, for example, stainless steel, and has a diameter in the range of 0.010 inch. The wire 52 can be attached to the registration plate 40 by an attachment means, such as, for example, by crimping a ring terminal 54 onto the end of the wire 52 and securing the ring terminal 54 in a recess in the registration plate 40. The wire 52 is routed to a guide 56*a* located at a corner of a respective opening 42. The wire is strung across an opening 42*a*, routed by additional wire guides 56*b*, 56*c*, 56*d* . . . 56*g* located on the edges of the opening 42*a*. As can be seen in FIG. 2, each opening 42*a*-42*d* preferably has its own wire 52 that is routed using guides 56*a*-56*g*. The guides 56*a*-56*g* can be mounted flush to the registration plate 40 or within small recesses within the registration plate 40. Since the nozzles of each of the print head nozzle arrays 44 do not extend the full length of the nozzle arrays (there is a small area at the top and bottom of each array that is not provided with nozzles), as illustrated in FIG. 3, the guides 56*a*-56*g* can be positioned and mounted such that the wire 52 can zigzag across the opening 42*a* only in locations where there are no nozzles of the print head nozzle arrays 44, thereby avoiding obstruction of the ink droplets as they are fired from the print head nozzles. It should be understood that while FIG. 2 illustrates seven guides (56*a*-56*g*) per opening 42, the actual number of guides provided will be dependent on the size of the opening 42 and the number of print nozzles arrays 44 that are provided within the opening 42.

Figure 4:
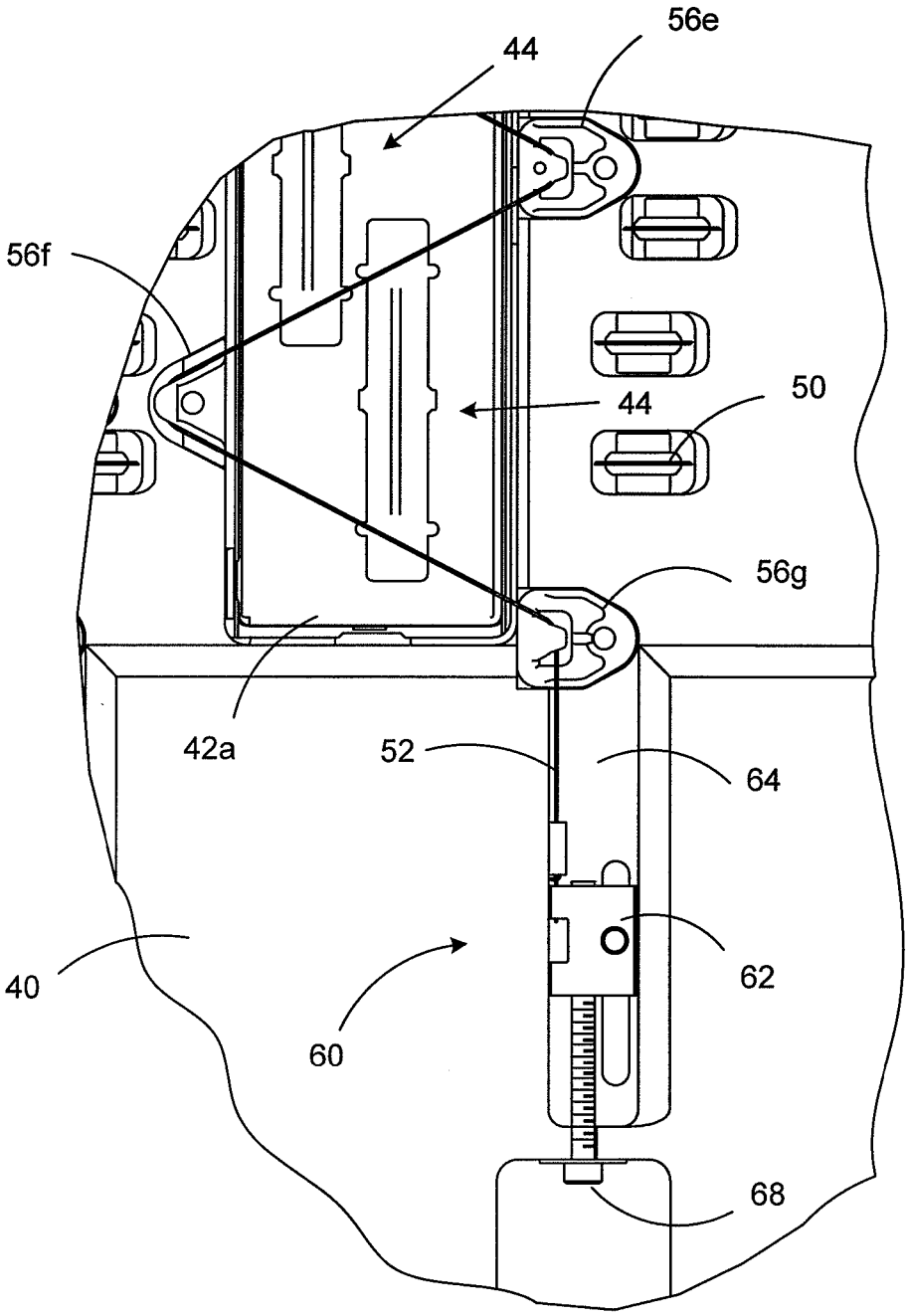
FIG. 4 illustrates an example of a tensioning device according to an embodiment of the present invention.

The end of the wire 52 is preferably attached to a tensioning device 60 that allows the tension of the wire 52 to be adjusted (either manually or automatically) to remove any slack in the wire 52. An example of such a tensioning device is illustrated in FIG. 4. The wire 52 is routed by a guide 56 located near the lower corner of the opening 42 to run parallel to the opening 42 and is attached to a block 62 that is located in a channel 64 of the registration plate 40. The block 64 can be formed of sheet steel, for example. The block 62 is adapted to receive a screw 68, which is mounted in an opening in the side of the registration plate 40 and screwed into the block 62. By turning the screw 68, the block 62 can slide either towards or away from the guide 56, thereby either loosening or tightening the wire 52. It should be understood that the tensioning device 60 illustrated in FIG. 4 is exemplary only, and other types of tensioning devices, e.g., spring devices, can be utilized.

By having the guides 56 mounted either flush with the bottom surface of the registration plate 40 or within a respective recess in the registration plate 40, the wire 52 is preferably located between the planes established by the edges of the idler rollers 50 and the surface of the print head nozzle arrays 42, thereby reducing the amount of direct contact between the mail piece surface and the wire 52. Additionally, the relative thinness of the wire 52 minimizes the build-up of ink on the wire 52 due to the ink jet aerosol overspray. Such build-up is undesirable, as it may lead to subsequent transfer of the ink to the mail piece when a mail piece does contact the wire 52.

When a mail piece that is very puffy or highly distorted is being processed by the mail processing system 10, the wire 52 extending across the opening 42 will prevent the mail piece from protruding up into the openings 42, thereby preventing the mail piece from contacting the print head nozzle arrays 44. By preventing such protrusion in to the opening 42, any ink smearing or damage to the print head nozzle arrays 44 can be prevented. By providing the wire 52 to act as a guide to maintain the optimal gap between the mail piece top surface and the print nozzles, better print quality can be provided, as well as preventing damage to the print head nozzle arrays 44 caused the mail piece contacting the print nozzles.

It should be understood that while the above description was with respect to a mailing system 10, the present invention is not so limited and can be utilized with any type of printing system.

While preferred embodiments of the invention have been described and illustrated above, it should be understood that they are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A registration device for a printing system having a print head, the registration device comprising:

a registration plate located beneath the print head to register a surface of an article to be printed a predetermined distance from a nozzle array of the print head;

an opening in the registration plate to expose the nozzle array to the surface of the article for printing on the surface of the article as the article is being transported past the opening; and a wire strung across at least a portion of the opening in the registration plate, the wire acting as a barrier to prevent the article from protruding into the opening in the registration plate.

2. The registration device of claim 1, further comprising:

a plurality of guides located on an edge of the opening, the plurality of guides routing the wire across the opening.

3. The registration device of claim 2, wherein the plurality of guides route the wire across the opening in areas where there are no nozzles of the nozzle array.

4. The registration device of claim 3, wherein the print head includes a plurality of nozzle arrays, and the plurality of guides route the wire across the opening in areas where there are no nozzles of any of the plurality of nozzle arrays.

5. The registration device of claim 1, further comprising:

a tensioning device attached to the wire to allow tension adjustment of the wire.

6. The registration device of claim 1, wherein the wire is formed of stainless steel and has a diameter of approximately 0.010 inches.

7. A mail processing system comprising:

a transport device to transport an article through a feed path of the mail processing system;

a printing device located along the transport for printing on a mail piece, the printing device including a print head having a nozzle array;

a registration plate located beneath the printing device to register a surface of a mail piece a predetermined distance from the nozzle array, the registration plate including an opening to expose the nozzle array to the surface of the mail piece for printing on the surface of the mail piece as the mail piece is being transported by the transport device along the feed path; and a wire strung across at least a portion of the opening in the registration plate, the wire acting as a barrier to prevent the mail piece from protruding into the opening in the registration plate.

8. The mail processing system of claim 7, further comprising:

a plurality of guides mounted to the registration plate along at least one edge of the opening, the plurality of guides routing the wire across the opening.

9. The mail processing system of claim 8, wherein the plurality of guides route the wire across the opening in areas where there are no nozzles of the nozzle array.

10. The mail processing system of claim 9, wherein the print head includes a plurality of nozzle arrays, and the plurality of guides route the wire across the opening in areas where there are no nozzles of any of the plurality of nozzle arrays.

11. The mail processing system of claim 7, further comprising:

a tensioning device attached to the wire to allow tension adjustment of the wire.

12. The mail processing system of claim 7, wherein the wire is formed of stainless steel and has a diameter of approximately 0.010 inches.

* * * * *